US008973337B2

(12) United States Patent
Hires et al.

(10) Patent No.: US 8,973,337 B2
(45) Date of Patent: Mar. 10, 2015

(54) MODULAR SHEET METAL BUILDING KIT

(71) Applicants: William Hires, Three Rivers, MI (US); Matthew Hires, Three Rivers, MI (US)

(72) Inventors: William Hires, Three Rivers, MI (US); Matthew Hires, Three Rivers, MI (US)

( * ) Notice: Subject to any disclaimer, the term of this patent is extended or adjusted under 35 U.S.C. 154(b) by 0 days.

(21) Appl. No.: 13/959,850

(22) Filed: Aug. 6, 2013

(65) Prior Publication Data

US 2014/0047795 A1 Feb. 20, 2014

Related U.S. Application Data

(60) Provisional application No. 61/691,037, filed on Aug. 20, 2012.

(51) Int. Cl.

| | |
|---|---|
| ***E04H 3/00*** | (2006.01) |
| ***E04C 2/34*** | (2006.01) |
| ***E04C 2/30*** | (2006.01) |
| ***E04C 2/08*** | (2006.01) |
| ***E04C 2/36*** | (2006.01) |
| ***E04B 1/08*** | (2006.01) |
| ***E04B 1/18*** | (2006.01) |

(52) U.S. Cl.

CPC ... *E04C 2/30* (2013.01); *E04C 2/08* (2013.01); *E04C 2/36* (2013.01); *E04B 1/08* (2013.01); *E04B 1/18* (2013.01)

USPC ..... 52/794.1; 52/79.12

(58) Field of Classification Search

CPC ..... E04C 2/292; E04C 2/34; E04C 2/384

USPC ..... 52/588.1, 794.1, 79.12

See application file for complete search history.

(56) References Cited

U.S. PATENT DOCUMENTS

| | | | | |
|---|---|---|---|---|
| 2,363,164 | A * | 11/1944 | Waller | 52/282.5 |
| 2,836,266 | A | 5/1958 | Lesser | |
| 3,353,318 | A | 11/1967 | Bachler | |
| 4,104,840 | A | 8/1978 | Heintz | |
| 4,261,146 | A * | 4/1981 | Holmes | 52/238.1 |
| 4,267,679 | A | 5/1981 | Thompson | |
| 4,546,590 | A * | 10/1985 | Finch et al. | 52/520 |
| 4,557,091 | A * | 12/1985 | Auer | 52/282.3 |
| 5,373,678 | A | 12/1994 | Hesser | |
| 5,425,210 | A | 6/1995 | Zafir | |
| 5,497,589 | A | 3/1996 | Porter | |
| 5,647,181 | A * | 7/1997 | Hunts | 52/282.1 |
| 6,085,477 | A * | 7/2000 | Hiese et al. | 52/270 |
| 6,502,357 | B1 * | 1/2003 | Stuthman et al. | 52/241 |
| 6,510,807 | B2 * | 1/2003 | Gottfried | 114/78 |
| 7,877,960 | B2 * | 2/2011 | Kennedy | 52/800.1 |
| 8,539,732 | B2 * | 9/2013 | Leahy | 52/745.13 |

(Continued)

*Primary Examiner* — Elizabeth A Plummer

(74) *Attorney, Agent, or Firm* — Daniel Boudwin; Global Intellectual Property Agency LLC

(57) ABSTRACT

A modular construction kit for erecting a building is provided. The kit comprises a plurality of base track sections, a plurality of roof receiving tracks, and a plurality of wall panels. The base track is a U-shaped channel that extends around the base of the building and maintains the lower edges of the wall panels in a linear alignment. Wall panels include male, female, and hybrid (male/female) varieties, each variety having a different tongue and groove configuration on laterally opposing ends of the panel. Each wall panel has an outer skin and an inner skin separated by two divider walls and a structural bridge, which provide structural support across two axes. The roof receiving track is affixed to the upper edges of the wall panels to provide a supporting shelf for a roof structure. Thus, the invention is an easy to assemble kit for rapidly erecting buildings.

6 Claims, 11 Drawing Sheets

(56) References Cited

U.S. PATENT DOCUMENTS

2003/0233796 A1* 12/2003 Walz et al. ..... 52/200
2004/0134162 A1* 7/2004 Douglas ..... 52/741.1
2005/0246968 A1* 11/2005 Wood ..... 52/79.12
2008/0000176 A1 1/2008 Mandelzys
2010/0325971 A1* 12/2010 Leahy ..... 52/79.1
2013/0305648 A1* 11/2013 Spear ..... 52/588.1

* cited by examiner

MODULAR SHEET METAL BUILDING KIT

CROSS REFERENCE TO RELATED APPLICATION

This application claims the benefit of U.S. Provisional Application No. 61/691,037 filed on Aug. 20, 2012, entitled "Locked Strong Pre Insolated Structural Steel Panel Kits." The patent application identified above is incorporated here by reference in its entirety to provide continuity of disclosure.

BACKGROUND OF THE INVENTION

1. Field of the Invention

The present invention relates to a kit for building structures. More specifically, the invention is a kit contains interlocking walls that are secured together using fasteners. The kit facilitates rapid assembly and disassembly of building structures such as sheds, tool workshops, walk-in freezers and the like.

Small building structures such as sheds, barns, mobile homes and the like are generally constructed from a plurality of prefabricated materials to bring down costs. This is because the time, labor, and material cost needed to construct such a structure from "scratch" usually exceed the structure's worth. Prefabricated panels and construction kit effectively reduce the cost of building a structure because material measurement and cutting is performed in a facility prior to building construction. The completed panels are then transported to the construction site and assembled. This procedure drastically reduces material preparation time, material transportation costs to and from the site, and the amount of labor time needed to erect a structure.

There are many different varieties of prefabricated construction panels. One common form of panel is formed from two sheet metal panels separated by lightweight polymer foam. Panels may be smooth, ribbed, or honeycombed surfaces. These panels are generally aligned in an end to end configuration and joined together using a fastening means. Fastening by tongue and groove engagements, caulking, and riveting or screwing, are all common forms of panel securement.

The problem with current prefabricated panels is that they do not have a strong base even when assembled. Though the panels are secured together, they are not protected from lateral warping. A construction panel kit is needed that holds the panels in lateral alignment and thereby reduces the likelihood of warping.

2. Description of the Prior Art

The present invention is a kit for building a steel structure. A number of pieces are contained within the kit and the exact number of elements will vary according to the size of the structure. The kit includes a plurality of base tracks, a plurality of roof receiving tracks, and a plurality of sheet metal wall panels. Each of the wall panels has an outer and inner wall connected by two bridging walls, disposed perpendicularly to the outer and inner walls and forming a hollow interior. Portions of the outer and inner walls extend past the bridging walls creating tails on either side of the interior space. Some wall panels have indented tails and are therefore male parts. The male panel tails fit within the space created by female panel tails thereby forming an interlocking connection. A number of wall panels are connected in this way and placed within the base track portions. Once all wall panels are assembled within the base track the roof receiving tracks are placed over the panels. Fasteners are used to secure the panels in place. The following references form a list of prior art deemed relevant to the present disclosure.

Hesser, U.S. Pat. No. 5,373,678 teaches a plurality of interlocking wall panels that connect together in an end to end fashion. Each panel has outer and inner metal skin spaced by an intermediate insulating core of foamed polymer. Every panel has at least one interlocking edge having a metal lined tongue and a metal lined groove shaped for each metal tongue to fit into opposing grooves on abutting panels. Once the panels are properly engaged they are affixed in place with fasteners that slide through appropriate channels within the panels. Hesser does not teach panels having bridging walls perpendicular to the outer skins, to increase structural integrity of individual panels. Further, Hesser does not disclose the use of a base track and a roofing receiver track for holding the panels in place.

Similarly, Thompson, U.S. Pat. No. 4,267,679 teaches a plurality of interlocking wall panels. A first set of interlocking metal sheets form outer walls and a second set of interlocking metal sheets form the inner walls. The interlocking portions form rectangular columns within the walls when connected. Fasteners are secured through the inner and outer skins and into the column to secure the panels in place. Like the Hesser invention, Thompson does not teach a base track or a roof receiving track.

Another interchangeable, interlocking wall panels are disclosed in Mandelzys, U.S. Patent Application Publication No. 20080000176 as a wall panel with an outer and inner skin and flanged side portions. The flanged side portions interconnect to make a wall or roof. Each outer wall skin has regular protrusions along its length that facilitate rainwater run-off. Porter, U.S. Pat. No. 5,497,589 discloses wall panels with outer and inner metal skins sandwiching a foam insulation layer. A female panel has two tongues formed from the outer and inner skins and the male panel has a mating protrusion along each edge. Zafir, U.S. Pat. No. 5,425,210 also discloses a plurality of interlocking wall panels with outer and inner skins. The Zafir panels have side protrusions that mate when placed in an end to end configuration. The side portions of the Zafir panels extend from the outer and inner skins without discontinuity. Further examples of basic modular panel construction are shown in Bacher, U.S. Pat. No. 3,353,318, Leeser U.S. Pat. No. 2,836,266, and Heintz, U.S. Pat. No. 4,104,840.

These prior art devices have several known drawbacks. None of them disclose a base track for receiving the bottom edges of the wall panels or roof receiving panels that cover the upper edges of the connected wall panels. These elements facilitate end to end alignment of the wall panels and reduce warping or buckling of the wall. Thus the present invention provides improved structural integrity and reduced likelihood of wall panel failure. It substantially diverges in design elements from the prior art and consequently it is clear that there is a need in the art for an improvement to existing modular structure kits devices. In this regard the instant invention substantially fulfills these needs.

SUMMARY OF THE INVENTION

In view of the foregoing disadvantages inherent in the known types of structure construction kits now present in the prior art, the present invention provides a new base track and roof mounting track wherein the same can be utilized for providing convenience for the user when quickly constructing outdoor buildings.

The present invention is a structure construction kit that includes a number of prefabricated metal walls, corner walls, base tracks, and roof receiving tracks. These pieces are assembled and fastened in a variety of configurations to create a sturdy building structure. Outdoor storage areas such as sheds, barns, walk in freezers and the like are easily erected using simply the present kit and a plurality of screw fasteners.

Three types of wall panels are provided, a male, female, and hybrid panel. Each wall is constructed from two pieces of sheet metal separated by two perpendicular spacers. The sheet metal walls extend out past the spacers creating tongues. Male wall sections have tongues that extend straight past the spacers without derivation. Conversely, the female wall sections have tongues that indent inward as they extend past the spacers. Thus the female tongues are recessed to receive the male tongues. Hybrid wall panels have male tongues extending from one side and female tongues extending from the other. The panels can be arranged in end to end abutment with interlocking tongues to create a sheet metal wall.

A base track and roof receiving track facilitate maintained linear alignment of the assembled wall panels. The tracks are U-shaped channels having raised sides. When the lower edges of wall panels are placed within the base track its upper sides extend over part of the panel thereby keeping it from twisting or deforming. Similarly, the roof receiving track has an inverted U-shape with sides extending down over an upper portion of inserted wall panels. Along the exterior perimeter of the roof receiving track is an upwardly extending lip. In this way the top of the roof-receiving track is a shelf with a perimeter boundary, which is capable of supporting a roof assembly and preventing it from sliding off the supporting walls.

It is therefore an object of the present invention to provide a new and improved structure construction kit device that has all of the advantages of the prior art and none of the disadvantages.

It is therefore an object of the present invention to provide a modular building construction kit having walls that do not warp or linearly deform after being assembled.

Another object of the present invention is to provide an easy to assemble building construction kit for a durable building structure.

Yet another object of the present invention is to provide a building construction kit having multiple types of wall engagements to facilitate flexible arrangement of wall panels.

Still another object of the present invention is to provide a structure construction kit that provides a stable base and roof support for a building.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
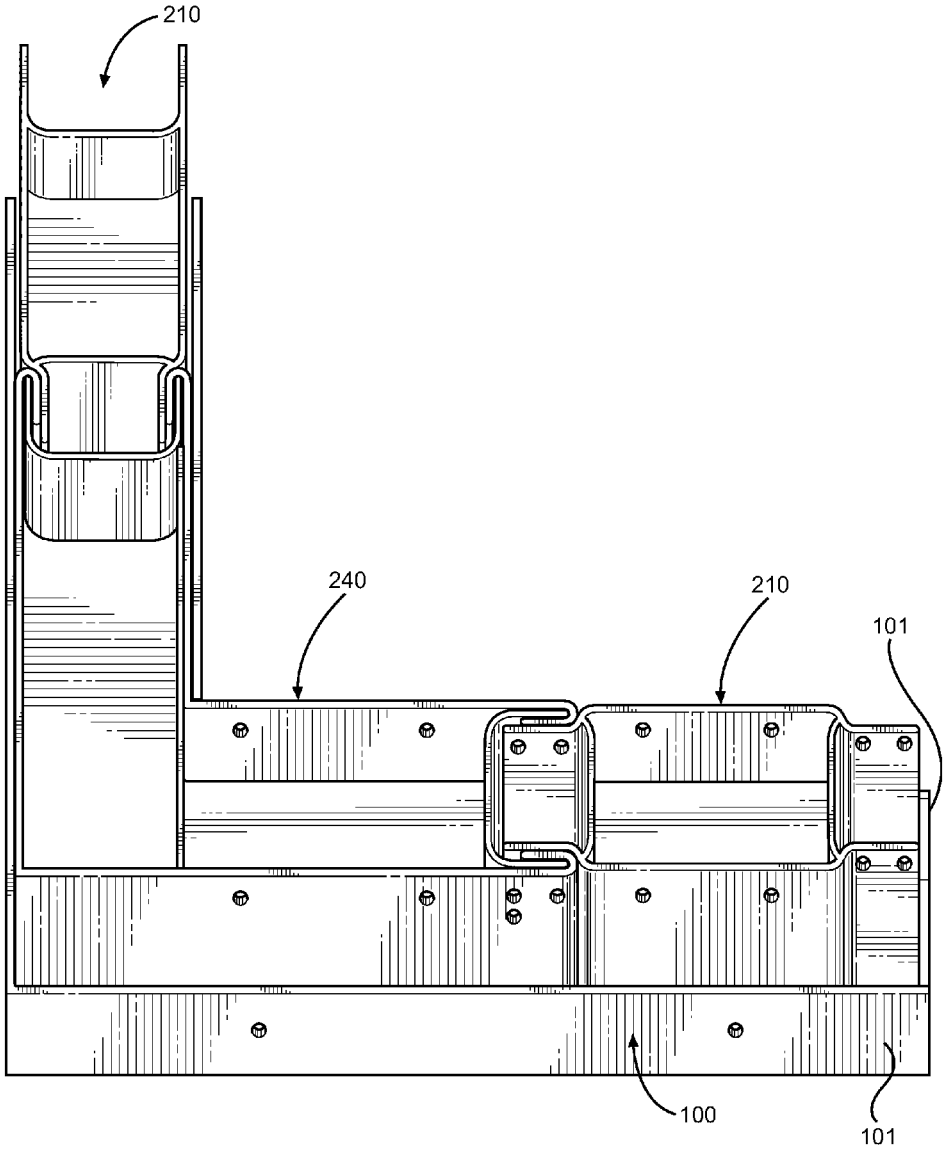
FIG. 1 is a perspective view of the construction kit. Several of the wall panels are assembled within the base track for improved stability.

Reference is made herein to the attached drawings. Like reference numerals are used throughout the drawings to depict like or similar elements of the modular structure construction kit. For the purposes of presenting a brief and clear description of the present invention, the preferred embodiment will be discussed as used for erecting stable structures such as small buildings. The figures are intended for representative purposes only and should not be considered to be limiting in any respect.

Referring now to FIG. 1, there is shown modular construction kit in a partially assembled state. The base track 100 holds a number of wall panels including two female wall panels 210, and a corner wall panel 230. Individual wall panels are joined to each other via a tongue and groove connection. Lower edges of the wall panels fit within the U-shaped channel of the base track. The upwardly extending walls 101 of the base track cover a portion of the inside and outside surfaces of the wall panels. This provides reinforcement that reduces buckling at the connection pints between wall panels. Once all wall panels are placed within the base track and fastened together, the roof-receiving track (not shown) is placed over the upper edges of the walls to further reduce buckling. The resulting structure is a sturdy, durable building that can be used for a variety of purposes.

Figure 2A:
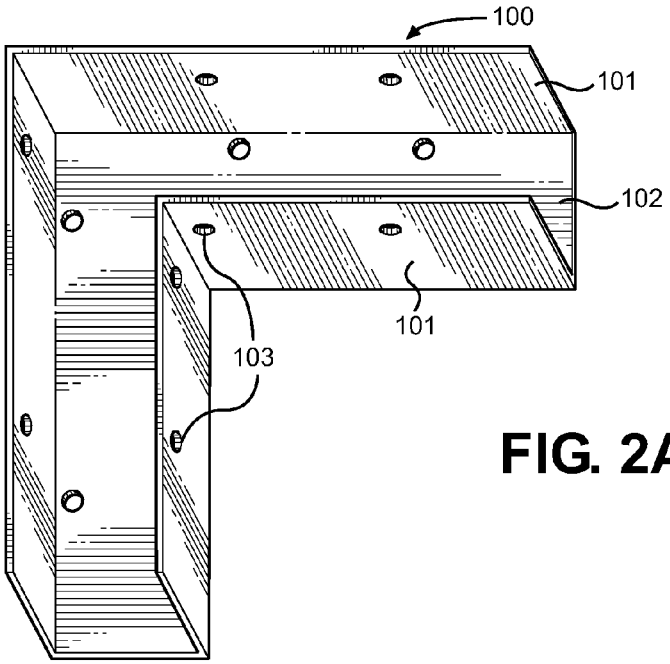
FIG. 2A is a perspective view of the corner base track component of the present modular structure building kit.

A section of the kit base track is shown in FIG. 2A. The track 100 is a U-shaped channel having two upstanding sides 101 and a bottom 102. Shown is a corner track, which connects two track segments at a right angle. Corner wall panels are inserted into the corner track along their lower ends to immobilize the wall panel and reduce shifting. Apertures 103 are disposed the length of the upstanding walls to facilitate securement of wall panels within the track segments.

Figure 2B:
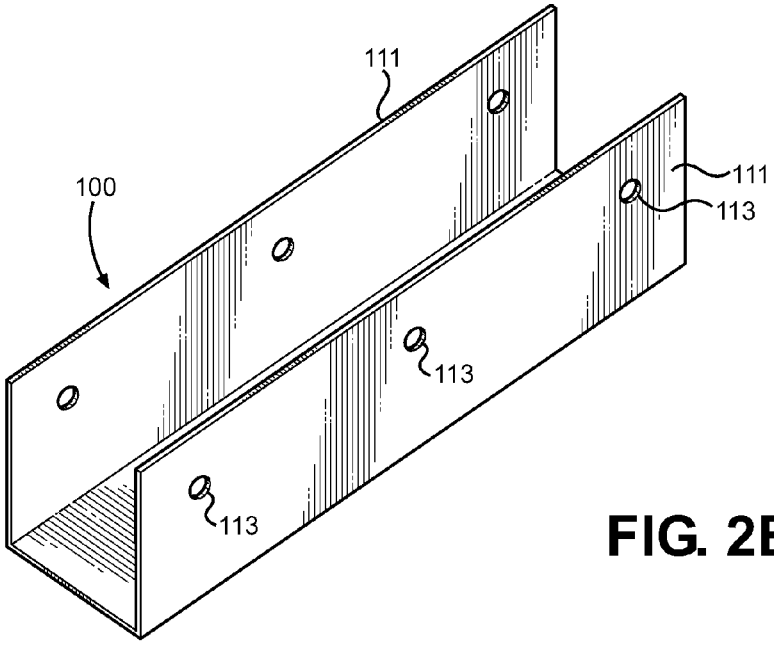
FIG. 2B shows a perspective view of the sidewall base track component of the modular construction kit.

A number of straight base track segments are provided to align wall panels in a linear end to end configuration. A straight sidewall base track segment is shown in FIG. 2B. In use, the straight base tracks 110 are lined up, abutting the corner tracks to form a generally rectangular pattern. The lower edges of wall panels are placed within the U-shaped channels, along the track bottom 112, until the tracks are filled. Apertures 113 in the sides of the track channel walls 111 are securement points for fasteners such as screws or rivets. In this way, wall panels are fastened within the U-shaped channels.

Construction of the base tracks may vary slightly. The tracks are made from sheet metal. The outer upstanding wall is formed from an approximately sixteen gauge sheet metal, and the inner upstanding wall is formed from twenty-two gauge sheet metal. Use of a lower gauge metal on the outer track walls assists in the prevention of outward buckling, which damage wall integrity and lead to structural collapse.

Figure 3A:
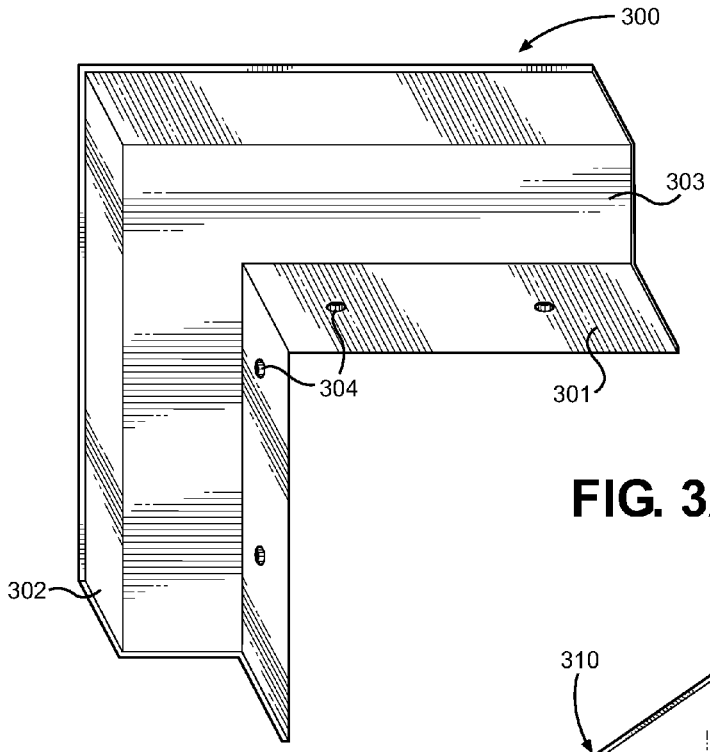
FIG. 3A shows a perspective view of the corner roof receiving track of the present modular construction kit.

Turning now to FIG. 3A there is shown a view of the roof receiving track 300. This track is a Z-shaped channel with one downwardly extending side 301, one upwardly extending side 302, and a top 303. The outer side wall extends up past the top surface forming a perimeter wall around the top upper surface. The downwardly extending side fits flushly along the inside of the wall panels, which the top rests upon when the track is in place. Several securement apertures 305 are disposed along the downwardly extending wall to provide securement points. A corner section of the roof receiving track is shown in the figure.

Figure 3B:
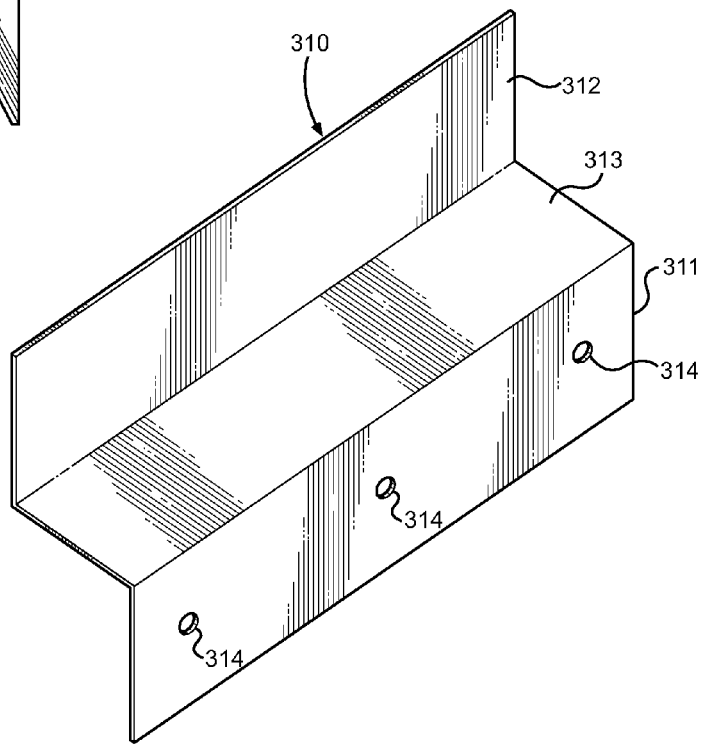
FIG. 3B shows a perspective view of the sidewall roof receiving track of the modular construction kit.

In FIG. 3B there is shown a straight sidewall portion of the roof receiving track 310. Upper edges of the wall panels are covered by the roof receiving track top 313 which rests thereon when in use. Maintaining the upper and lower edges of the panels within the base track and roof receiving track greatly reduces buckling of the panels, and consequently reduces wall deformation or warping. Panels can be secured to the roof receiving track by inserting fasteners through apertures 314 in the downwardly extending side 311, and into the wall panels. Once wall panels are firmly in place, a roof such as a standard or high-hat style roof can be placed on the receiving track. The roof is held in place via the upwardly extending side 312.

The top surface and perimeter wall of the roof receiving track form a shelf that a, on which a roofing structure may rest. Thus, the upper surface provides a shelf that is supported by the wall panels positioned with the downwardly extending channel. To prevent a roofing structure from sliding or shifting during use, the perimeter wall is provided along the outer edge of the roof receiving track. Roofing structures may rest upon the upper surface but will not slide off the completed building because of the boundary created by the perimeter wall.

Figure 4:
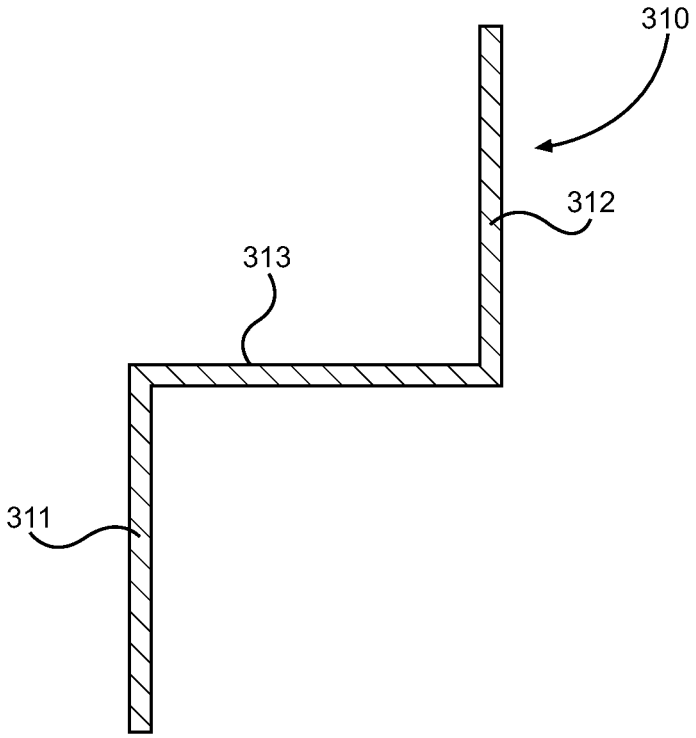
FIG. 4 shows a cross-section view of the sidewall roof receiving track.

Referring now to FIG. 4 there is shown a cross section of the roof receiving track 310. One side 312 extends upward from the outside edge of the upper surface of the track top 313. The laterally opposing edge of the top has a downwardly extending side 311. Overall, the roof receiving track has a Z-shape. In one embodiment the track may be formed from a single gauge of sheet metal that is bent into a z-configuration with a middle portion that is designed to lie flat across the upper edges of underlying wall panels. Alternatively, the track may be formed from sheet metal of varying gauges such as those discussed in the base track construction above.

Figure 5A:
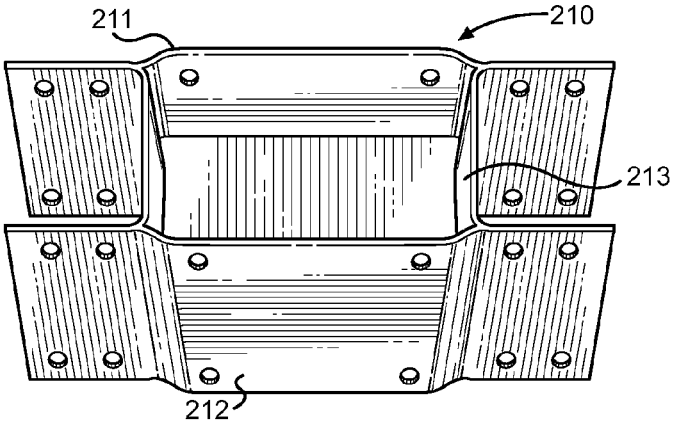
FIG. 5A shows an overhead view of an exemplary male wall panel of the modular construction kit.
Figure 5B:
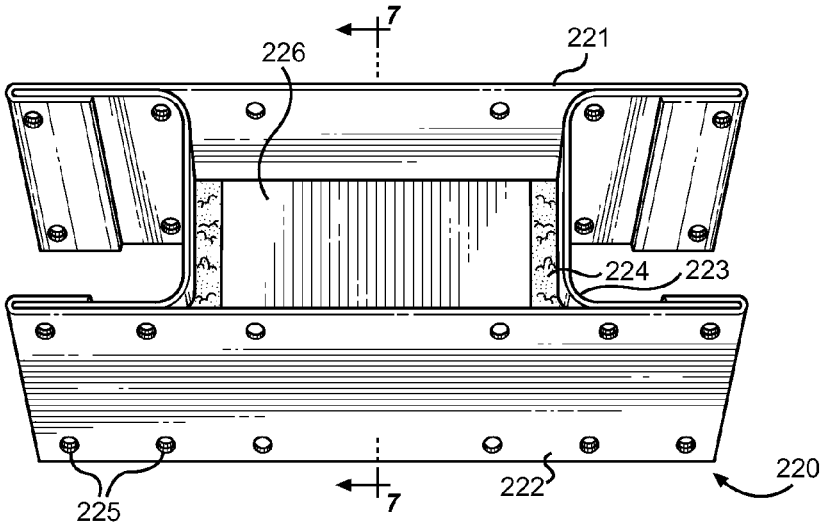
FIG. 5B shows an overhead view of an exemplary female wall panel of the modular construction kit.
Figure 5C:
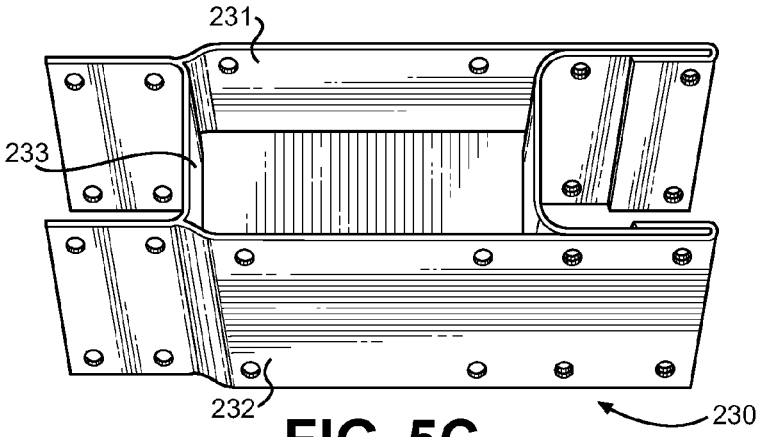
FIG. 5C shows an overhead view of an exemplary hybrid wall panel of the modular construction kit.

Examples of wall panels are shown in FIGS. 5A-5C. These panels are formed from an inner skin and outer skin joined by a pair of divider walls to form a channel. A portion of the outer and inner skins extend past the divider walls, forming a tongue and groove mating pair. Within the channel formed by the dividers, outer and inner skin is a structural bridge and insulation. The bridge extends between the outer and inner skin, lying orthogonal thereto. This bridge in conjunction with the divider walls provides structural support to the outer skin and inner skin, thereby reducing the risk that the two will crunch inward. Insulation may be inserted between the bridge and the two divider walls. Alternatively the bridge may extend between the divider walls as well as the outer skin and inner skin.

A view of the male wall panel section 210 is shown in FIG. 5A. The outer skin 211 and inner skin 212 of the wall panel are indented on either side of the divider walls 213. Depth of the indentation is approximately the width of the respective skin. By way of example, the outer skin portions that extend past the divider walls are indented approximately the measurement of their own thickness. Likewise, the inner skin portions that extend beyond the divider walls will be indented approximately the measurement of their thickness. It is understood that the amount of indentation will vary according to the thickness of each skin. This is important because the outer and inner skins may not be made of sheet metal of the same gauge. In use these extended portions or tongues, are inserted into receiving portions of the female wall panels, forming a tongue and groove fit.

Shown in FIG. 5B is the female wall panel section 220 of the present invention. The outer skin 221 and inner skin 222 of the wall panel extend straight across the area between the divider walls 223 and on either side thereof. These panels do not have indented skins. In this way, the female wall panels are adapted to receive the end portions of the male wall panels. The indented portions of the male wall panels mate with the non-indented portions of the female wall panels. Apertures 225 linearly disposed along the outer and inner skins of each wall panel provide fastening points for removably securing wall panels together. In the depicted example, the bridge 226 and divider walls do not abut, leaving small gaps that are filled with insulating foam.

A third type of wall panel is shown in FIG. 5C. This hybrid wall panel section 230 has a female (non-indented) set of outer skin 231 and inner skin 232 on one side and a male pair (indented) on the laterally opposing side of the wall panel. These wall panel sections are used in conjunction with the corner wall panels which have female ends on either side. Use of hybrid wall panels is necessary to ensure that the wall panels mate sufficiently in an end to end configuration. Without hybrid panels it is possible to have two abutting female sections without enough room to insert a male section to connect the two. Hybrid wall panels are used as gap fillers and balance the distribution of male and female wall panels.

Figure 6:
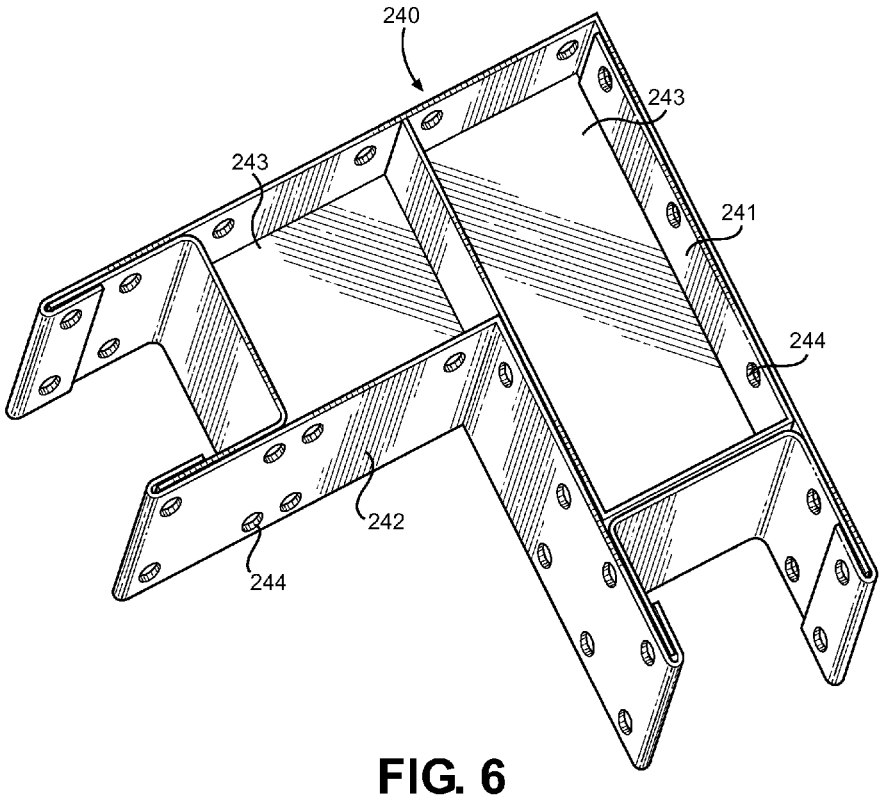
FIG. 6 shows an overhead view of an exemplary corner wall panel of the modular construction kit.

Referring now to FIG. 6 there is shown a corner wall panel section 240. Like the other wall panels, the corner sections have an outer skin 241 and inner skin 242 connected by a structural bridge 244. The corner section has the overall shape of a right angle. Female ends of the outer skin and inner skin extend from each end of the wall panel. Hybrid wall panels mate with the ends of the corner wall panel and are secured in place via fasteners. The fasteners are inserted through apertures 244 along the sides of the corner wall panel. When the four corner wall panels are mated with the other wall panels, a basic building structure is formed.

Figure 7:
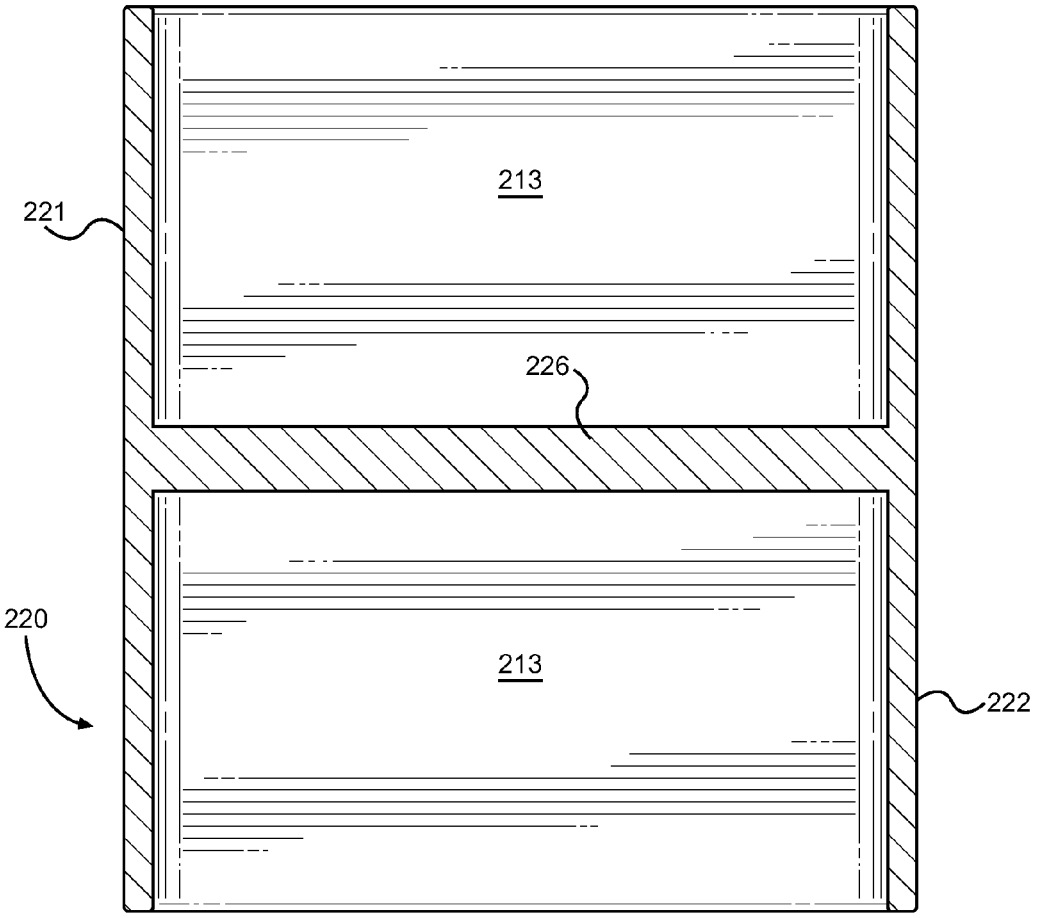
FIG. 7 shows a cross-section view of a wall panel of the present invention.

A cross-section view of the female wall panel section 220 is shown in FIG. 7. The structural bridge 226 extends across the gap between the outer skin 221 and inner skin 222. Behind the structural bridge, a divider wall 213 is shown. The structural bridge and divider walls provide support to the outer and inner skin cross two axes. In a preferred embodiment the outer skin is sixteen gauge sheet metal and the inner skin is twenty-two gauge sheet metal. Divider walls are formed from an eighteen gauge metal. These specifications may vary according to the needs of the environmental conditions in which the assembled building will sit.

Figure 8:
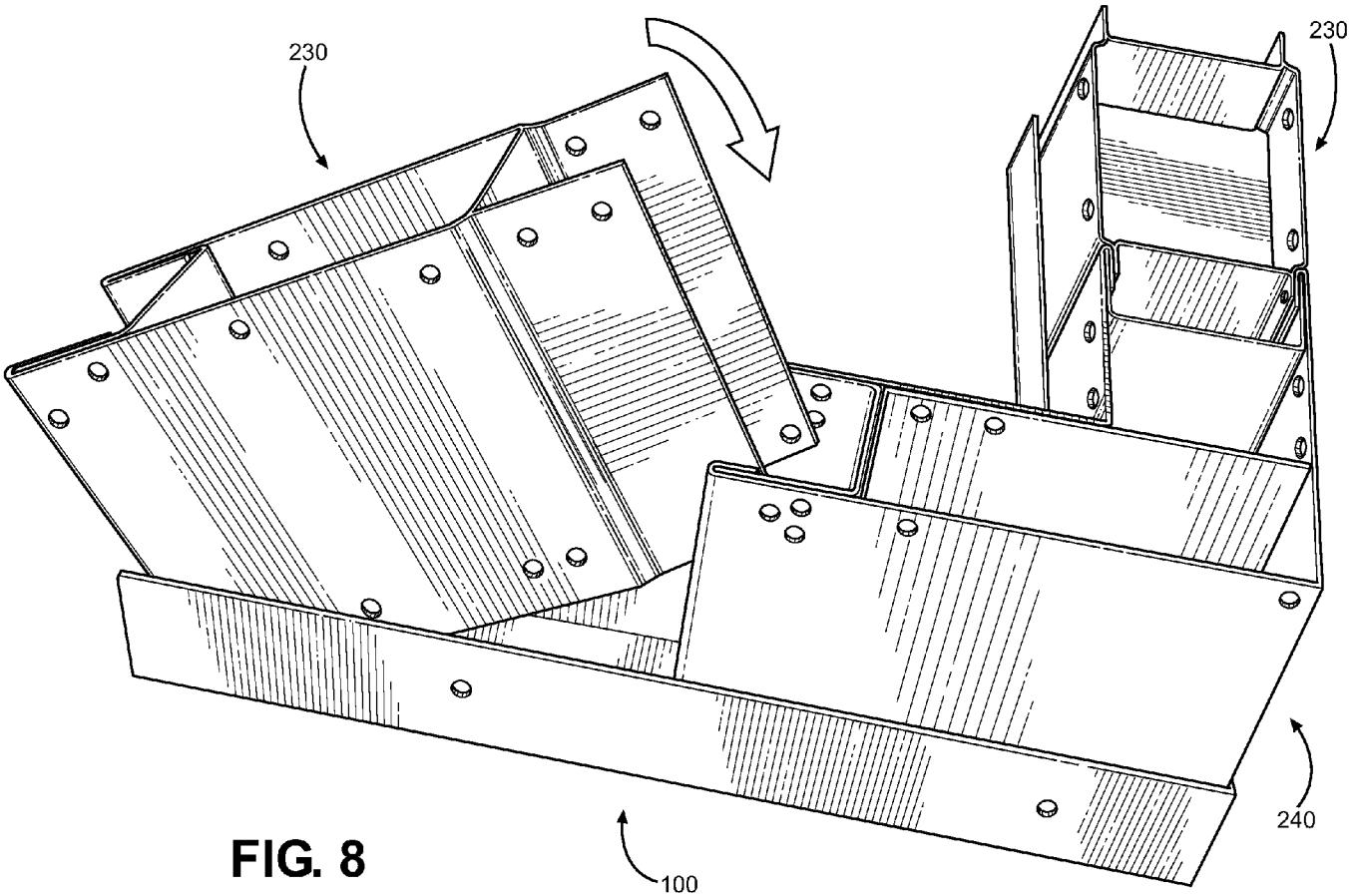
FIG. 8 shows a perspective view of the wall panels being inserted into the base track in an end to end alignment.

Turning now to FIG. 8, there is shown a view of the wall panels being inserted into a base track section 100. A corner section of base track is laid upon a flat surface while wall panels are inserted. The corner wall panel 240 is already in place within the base track and a first hybrid wall panel 230 is mated with the upper end of the corner wall panel. By way of example, a second hybrid panel is being inserted into the base track such that it's male end mates with the female end of the corner wall panel. Once the panels are firmly in place, their apertures will align with each other, as well as with those disposed on the base track. Fasteners (not shown) are then inserted to secure the components in place. This procedure is repeated around the entire perimeter of the building until all walls are in place. Once the walls are assembled, insulation is used to fill the interior volumes created by the mating pairs of outer and inner skins. Filling these regions with insulation helps keep the interior of the finished building warm and further strengthens the walls.

Figure 9:
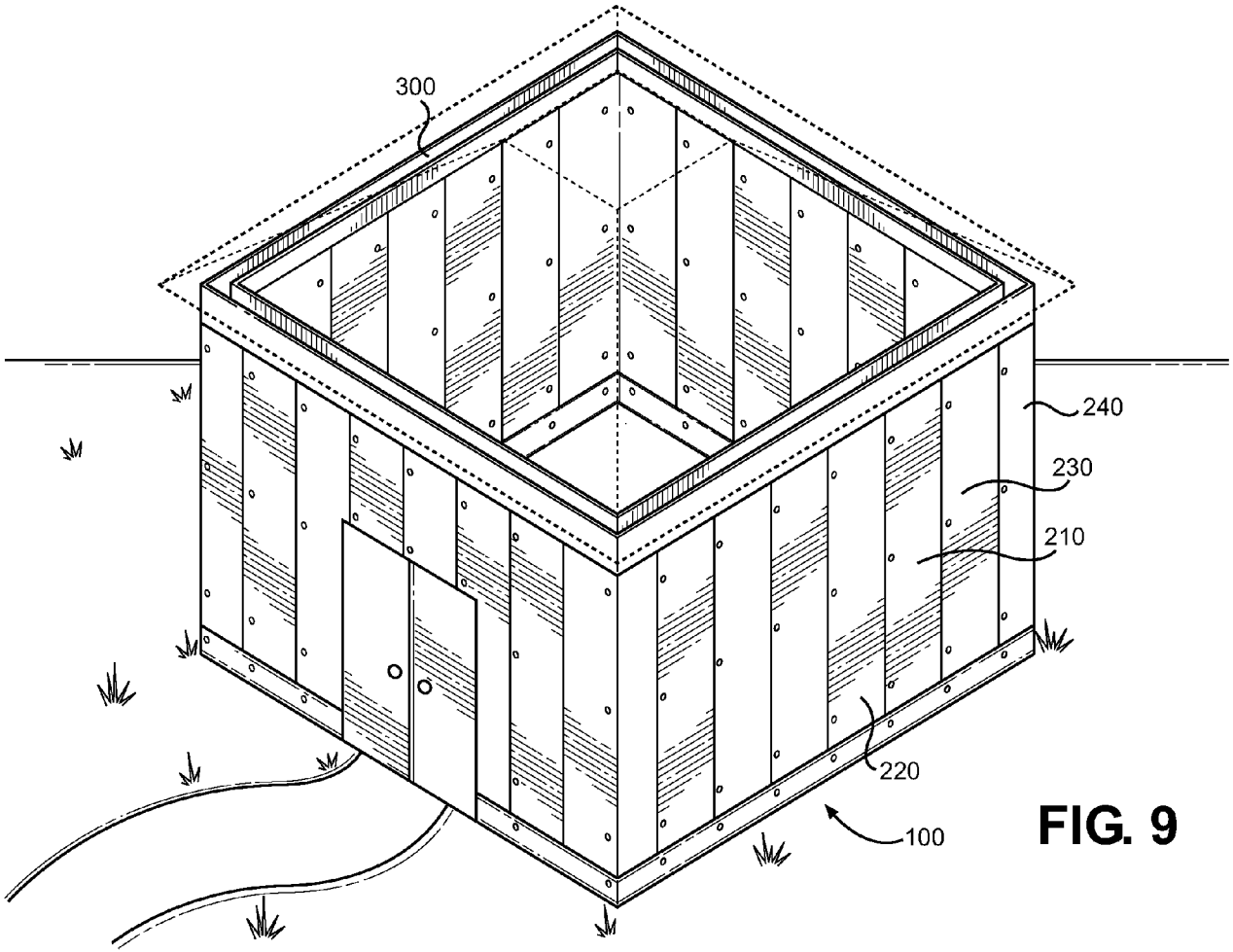
FIG. 9 shows an in use view of the modular construction kit as used to build a shed.

Next, FIG. 9 shows an exterior view of the exemplary assembled structure. All wall panels 210, 220, 230, 240 are mounted within and secured to the base track 100. Fasteners are inserted through the myriad of apertures to removably connect the panels and tracks together. Along the upper edge of the wall panels, the roof receiving track 300 is positioned. The inner, downwardly extending edge of the roof receiving track is secure along the inner skin of the wall panels. An exemplary roof (not included) is shown to illustrate what the completed building could look like.

Figure 10:
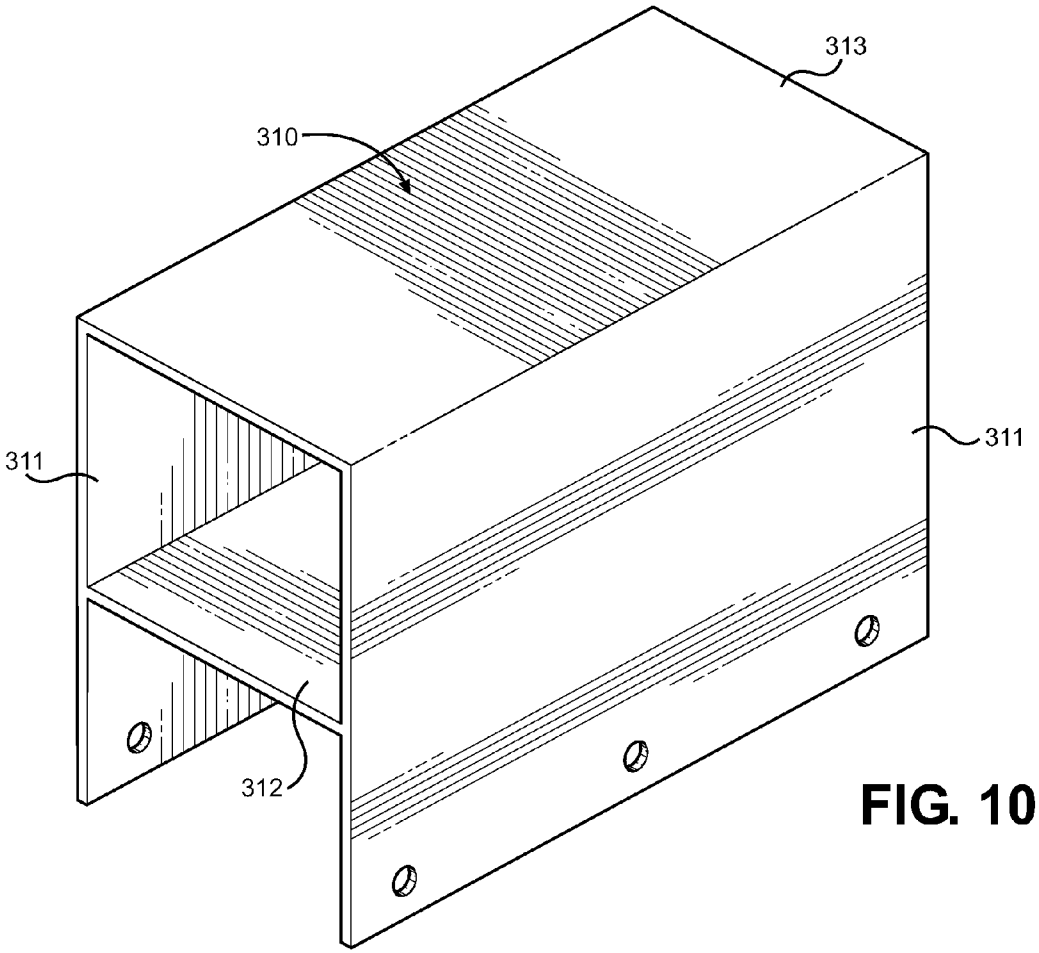
FIG. 10 shows a perspective view of an alternative embodiment of the roof receiving track. This embodiment has a high hat track style construction for facilitating installation of sloped roofing.

Turning now to FIG. 10, there is show a roof receiving track with a high hat upper portion. This high hat embodiment of the roof receiving track 310 has two walls 311 including both an upper wall parts and downwardly extending wall parts. The downwardly extending wall parts and an intermediate transverse section 312 form an inverted u-channel. An upper portion extends from the inverted-u channel and comprises two upstanding wall parts and a top 313. This upper portion forms a closed channel over the inverted-u channel. Sloped roofing is supported at its upper end by the high hat embodiment, while the regular embodiment of the roof receiving track is used at the opposing end of the roof to retain a lower edge. Apertures disposed along the track facilitate securement of same to the wall panels and to the roofing elements.

Figure 11:
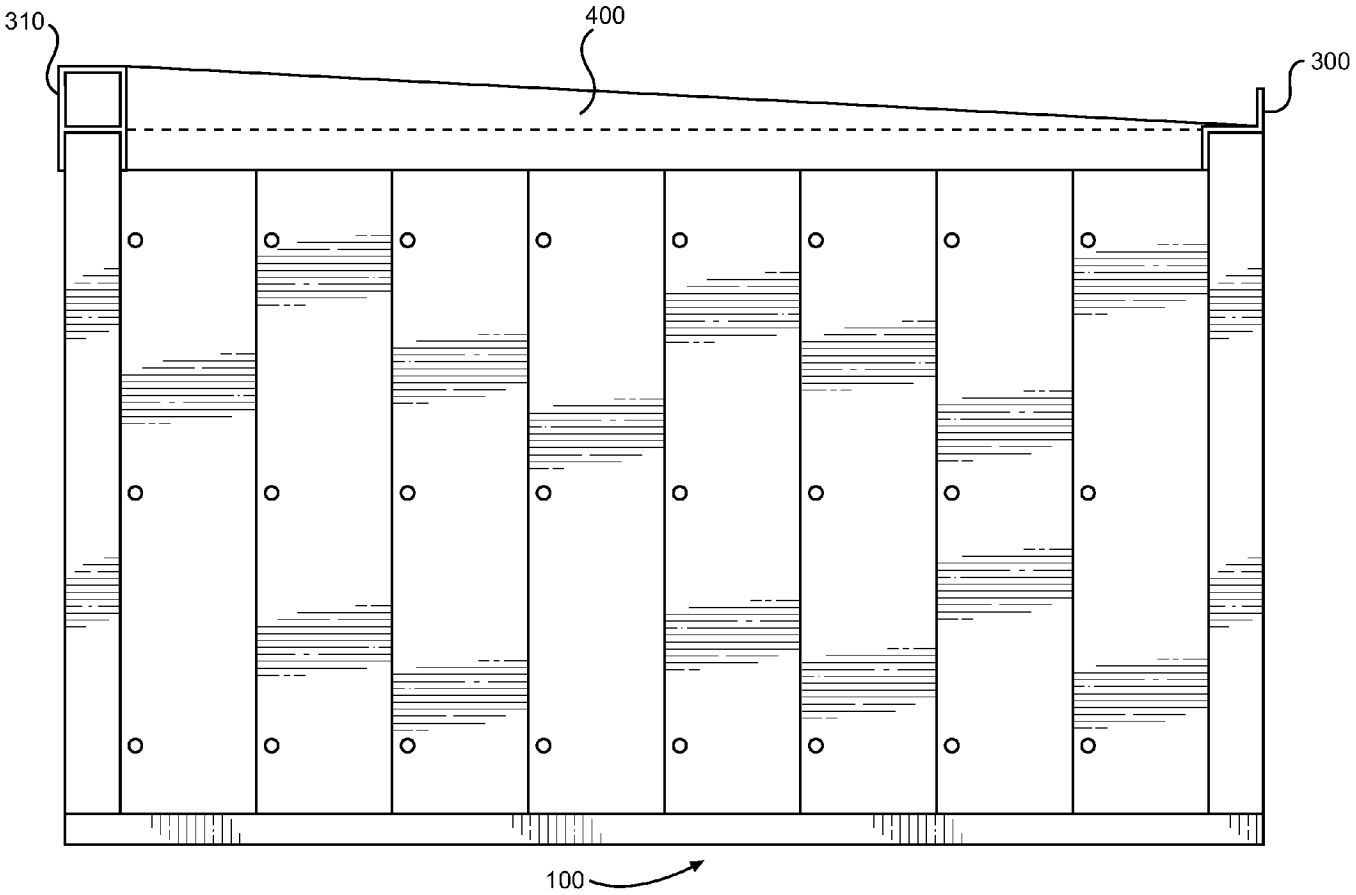
FIG. 11 shows a side view of an exemplary shed built from the present modular construction kit and employing the high hat roof receiving track with a sloped roof.

An example of the high hat sloped roof implementation of the modular construction kit is shown in cross-section in FIG. 11. Wall panels are affixed in position within the base track 100. A standard roof receiving track 300 is secured to upper edges of at least one side of the completed structure. On the opposing side of the assembled structure, the high hat embodiment of the roof receiving track 310 is secured. The upper portion of a sloop roof 400 is attached to the high hat roof receiving track. The lower end of the roof is held in place by the upstanding wall of the standard roof receiving track. Thus the standard track prevents the roofing element from sliding around while in use. Sloping the roof via use of the high hat roof receiving track facilitates rain water run-off and reduces the accumulation of debris on the building upper surface.

In use an individual determines the dimensions of the building he or she wants along with the placement area for the building. The ground is then leveled in preparation for building. When necessary, small trenches may be cut out of hillier ground to accommodate the base track. The tracks, which come in pre-cut lengths such as ten foot sections, are then cut down until an appropriate length and number of sections is obtained. These sections are laid out on the leveled ground to ensure dimensional exactitude. Corner wall panels are then inserted into the corner base track sections. Hybrid wall panel sections are placed along each end of the corner wall panel sections, such that their ends mate. Next, male wall panels are placed next to each open end of a hybrid wall panel, followed by female wall panels that mate with the previously placed male panels. This pattern of male to female wall panel alignment continues until the tracks are filled. Fasteners are then inserted through all apertures and secured into place. The roof receiving track is placed along the upper edges of the wall panels with the corner sections being installed first. After the roof receiving track Is firmly in place, a roof structure is placed on the upper surface of the roof receiving track top, such that the upstanding wall forms a barrier to prevent the roof from sliding off the building.

It will be obvious to those of ordinary skill in the building construction art that doors and windows can easily be incorporated into this structure. Physical dimensions of the door and frame are measured and. A corresponding amount of wall panels and base track are left out or removed from the area where the width of the door will sit. The wall panels designated to go above the door are cut down and may be mounted within a base track section disposed above the door frame or alternatively may be mounted directly to the door frame. In much the same way, windows can be added to the structure.

The present invention is a modular building construction kit. The components are made from various thicknesses of sheet metal to promote durability. Insulation is inserted in between panel connections, which improves thermal retention within the structure. The walls of the structure are mounted within a base track that stabilizes individual walls and maintains the lower wall edges in an end to end linear alignment. Because the components of the construction kit are prefabricated and removably securable via fasteners such as screws or rivets, a building can be assembled and erected within hours rather than days or weeks. Dimensions of the components will vary slightly according to their intended use. Large structures may require wider wall panels, or deeper tracks. Making such modifications will be known to one of ordinary skill in the art. Thus, the present invention provides users with a variety of options when rapidly constructing metal buildings.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A modular building construction kit, comprising:

a plurality of wall panels having a bridge portion, a pair of divider walls, apertures, and a pair of connectors extending laterally therefrom;

wherein said connectors comprise indented connectors and non-indented connectors, said indented and non-indented connectors having complementary apertures;

wherein said non-indented connectors are adapted to receive said indented connectors therein and said complimentary apertures of said indented connector are adapted to align with said complimentary apertures of said non-indented connector to receive fasteners therethrough;

a plurality of base tracks comprising a bottom portion and a pair of upstanding walls having apertures;

wherein said base tracks are adapted to receive wall panels therein and said apertures of said upstanding wall are adapted to align with said wall panel apertures to receive fasteners therethrough;

a plurality of roof receiving tracks having at least one downwardly-extending portion having apertures;

wherein said roof receiving tracks are adapted to receive wall panels therein and said apertures of said downwardly-extending portion are adapted to align with said wall panel apertures to receive fasteners therethrough;

wherein said wall panels, said base tracks, and said roof receiving tracks are adapted to form a free-standing structure having an interior surface and an exterior surface when secured together;

wherein said exterior surface and said interior surface are constructed of sheet metal and wherein said sheet metal of said exterior surface is lower gauge than said sheet metal of said interior surface in order to prevent outward buckling.

2. The modular building construction kit of claim 1, further comprising wall panels having a right angle shape.

3. The modular building construction kit of claim 1, further comprising base tracks having a right angle shape.

4. The modular building construction kit of claim 1, further comprising roof receiving tracks having a right angle shape.

5. The modular building construction kit of claim 1, further comprising insulating foam between said bridge and said divider walls.

6. The modular building construction kit of claim 1, further comprising roof receiving tracks having two sidewalls with downwardly-extending portions, an intermediate transverse surface extending between said sidewalls forming an inverted U-shaped channel, and an upper divider extending between said sidewalls forming an enclosed channel.

* * * * *